United States Patent [19]

Lupoli et al.

[11] Patent Number: 4,803,320

[45] Date of Patent: Feb. 7, 1989

[54] ELECTRIC SWITCH CONSTRUCTION

[75] Inventors: Peter J. Lupoli, Hamden; Donald J. Mattis, Norwalk, both of Conn.

[73] Assignee: Casco Products Corporation, Bridgeport, Conn.

[21] Appl. No.: 71,072

[22] Filed: Jul. 8, 1987

[51] Int. Cl.[4] ..... H01H 3/00

[52] U.S. Cl. ..... 200/342; 200/61.62

[58] Field of Search ..... 200/153 V, 159 R, 340, 200/DIG. 25, 61.62, 61.7, 61.71, 61.73, 61.74, 61.84

[56] References Cited

U.S. PATENT DOCUMENTS

| | | | |
|---|---|---|---|
| 1,974,910 | 9/1934 | Bondeson | 174/51 |
| 2,118,672 | 5/1938 | Green | 174/51 |
| 2,317,727 | 4/1943 | Bonanno | 200/1 B |
| 2,418,222 | 4/1947 | Fetter | 200/153 V |
| 2,528,520 | 11/1950 | Jackson et al. | 200/156 X |
| 2,921,155 | 1/1960 | Basso | 200/61.67 X |
| 3,141,936 | 7/1964 | Boyle et al. | 200/276 X |
| 3,172,981 | 3/1965 | Loesch | 200/61.76 X |
| 3,211,872 | 10/1965 | Baer | 200/276 X |
| 3,586,810 | 6/1971 | Brown | 200/153 V |
| 3,624,330 | 11/1970 | Bognar | 200/153 V |
| 3,710,048 | 1/1973 | Schumacher | 200/16 B X |
| 3,792,219 | 2/1974 | Rowley | 200/276 X |
| 4,022,999 | 5/1977 | Brown | 200/6 BA |
| 4,308,440 | 12/1981 | Buttner | 200/16 B X |
| 4,319,106 | 3/1982 | Armitage | 200/160 X |
| 4,476,359 | 10/1984 | Bienwald | 200/156 |
| 4,650,936 | 3/1987 | Lupoli et al. | 200/16 B |

*Primary Examiner*—Henry J. Recla
*Assistant Examiner*—Linda J. Sholl
*Attorney, Agent, or Firm*—Mitchell D. Bittman

[57] ABSTRACT

An electric switch construction having a body member with a a stationary electrical contact, a movable plunger in the body member and carrying a second electrical contact, and a compression spring, one end of which is carried by the plunger. The other end of the spring preferably carries an abutment or button, intended for engagement by an actuator, such as the hood of a motor vehicle. The spring constitutes a yieldable drive or link between the actuator and plunger, to compensate for dimensional variations that normally occur in the environment in which the switch is used, as well as minimizing deleterious effects of high impulse forces that would otherwise be applied by the actuator to the switch plunger, and also the effects of overtravel of the actuator. Improved reliability and longer switch life expectancy are thus realizeable.

6 Claims, 5 Drawing Sheets

ELECTRIC SWITCH CONSTRUCTION

CROSS REFERENCES TO RELATED PATENTS

The present application relates to improvements in the switch construction illustrated and described in U.S. Pat. No. 4,650,936 dated Mar. 17, 1987, entitled ELECTRIC SWITCH CONSTRUCTION, and having common ownership with the present application.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to electric switching devices, and more particularly to electrical switch units that incorporate a plunger-type actuator in order to effect the make and break operations. The invention is considered to have special utility in the automotive field, where typical switch devices are subjected to extremes of temperature, humidity, mechanical shock and rough handling, and yet are expected to operate satisfactorily over extended periods of time.

2. Description of the Related Art including information disclosed under 37 CRF §§1.97–1.99

In the past numerous push-button type electric switches have been proposed and produced, meeting with varying degrees of success. Many such devices were employed in automotive vehicles in conjunction with the vehicle's doors, being installed in the door jamb in order to operate courtesy lights, etc. Still others found wide acceptance for use with the vehicle's hood and trunk compartments, in order to indicate various conditions, such as when the hood was not fully latched, or for triggering alarm circuitry if unauthorized entry into the vehicle was attempted.

Frequently these switches were simple make-and-break devices having normally closed circuits, with the contacting surfaces at least partially exposed. Under such circumstances there was a tendency for moisture, salt, dirt and sand or other debris to become lodged in the switch mechanism, causing either erratic operation, deterioration, or eventual failure. Efforts to prevent the accumulation of such matter by means of sealed switch casings, have not led to much commercial success for the reason that the expense involved in providing an effective seal was not warranted, despite the multiple units that were employed on newer model vehicles. Yet it was considered important that such switches be reliable in operation, and not subject to breakdown under the extreme environmental conditions to which vehicles are typically subjected. Compromise constructions in general left something to be desired, considering the objectives of economy and useful life under adverse operating conditions.

Manual operation of plunger-type switches normally presents few problems as regards the extent of movement of the plunger, or the forces intended to be applied to the plunger. That is, the operator merely depresses the plunger or push button with a moderate force, until the desired circuit is energized or otherwise affected. However, with plunger-type switches that are intended to be automatically actuated by engagement of the switch plunger by a relatively massive member, such as the hood, trunk lid, or door of a vehicle, there arise problems in insuring that the physical dimensions and tolerances of the switch are in accord with the space requirements dictated by the particular application. Specifically it is necessary to insure that the plunger is not subjected to excessive force or impulses, since this could result in permanent damage to either the plunger, the switch housing, or the contact mechanism in the housing.

Also, where a massive object such as an automobile hood is moved, the resulting inertia can give rise to a considerable overtravel, often followed by a re-bound or backing-off. Prior switches have, for the most part, been unusable in such installations, due to the impulse forces applied to the switch plunger, and the adverse effects of such overtravel on the movement of the plunger.

Accordingly there has existed a long-felt need for a sturdy and reliable inexpensive switch which would perform satisfactorily under the circumstances noted above, and which would eliminate the problems that often plagued many of the prior switch arrangements.

SUMMARY OF THE INVENTION

The above drawbacks and disadvantages of prior electric switch devices are obviated by the present invention, which has for one object the provision of a novel and improved electric switch which is extremely simple in its construction, while at the same time being both rugged and reliable over extended periods of use.

Still another object of the invention is to provide an improved electric switch as outlined above and which is designed to be automatically self-adapted to the environment in which the switch is employed, thereby eliminating the likelihood of damage to the switch as a result of excessive forces being applied to the switch plunger, as for example by the hood or trunk lid of a motor vehicle.

A still further object of the invention is to provide an improved electric switch of the kind indicated, which is not adversely affected by either slamming, or overtravel and subsequent retraction of the actuator, such as a vehicle trunk lid or hood.

A related object of the invention is to provide an improved switch as above set forth, wherein basic components can be constituted largely of molded plastic material, and wherein such parts can be fabricated in relatively simple mold cavities.

Still another object of the invention is to provide an improved electric switch as above characterized, wherein the assembly of the various components can be readily accomplished by automated equipment, thereby reducing the overall manufacturing cost and minimizing operator-related error.

Yet another object of the invention is to provide an improved electric switch in accordance with the foregoing, wherein the surfaces of the conductors that establish the contacts are largely isolated from the environment, thus minimizing deterioration of the contacts that might otherwise result from the presence of dirt, moisture or other debris.

The above objects are accomplished by a unique, self-adapting electric switch construction comprising a body member having means for attaching it to a supporting structure, and having a stationary electrical contact and a movable electrical contact cooperable with the stationary contact for making and breaking an electrical circuit. The body member has a movable plunger operable to actuate the movable contact. A compression coil spring is carried by the plunger, for operation in response to movement of an external actuator, thereby to constitute a yieldable drive or linkage between the plunger and the external actuator.

More particularly, the objects are accomplished by a self-adapting electric switch construction comprising a housing, a fixed electric terminal insulatedly mounted in the housing a movable contactor mounted in the housing and movable between circuit closing and circuit opening positions, and resilient means for electrically connecting the fixed electrical terminal with the movable contactor and for imparting a bias to the contactor. There is a fixed contact in the housing, engageable by the movable contactor, and manually-operable means for actuating the movable contactor between its circuit closing and circuit opening positions. The manually-operable means comprises a movable plunger, and in addition there is a compression coil spring carried by the plunger, for operation by an external actuator, such as a vehicle's hood, thereby to constitute a yieldable driving means between the plunger and the external actuator.

The above arrangements are such that overtravel of the hood, such as occurs when it is slammed into its bumper pads, is absorbed by a momentary relatively large compression of the spring carried by the plunger. As a result, following such overtravel, the spring can thereafter expand, if necessary, when the hood retracts or re-bounds, under the action of such bumper pads.

Other features and advantages will hereinafter appear.

DESCRIPTION OF THE PREFERRED EMBODIMENT

Figure 1:
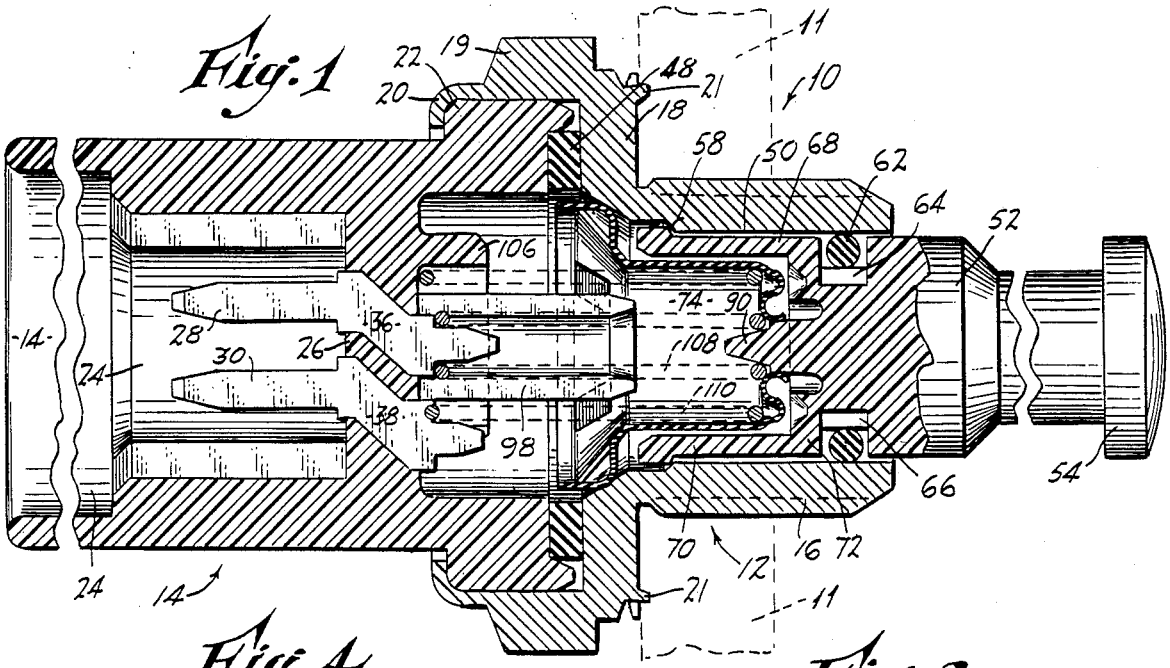
FIG. 1 is a fragmentary axial section of a switch construction of the type adapted for use with the self-adapting mechanism of the present invention, showing the various parts in a circuit closing position.
Figure 2:
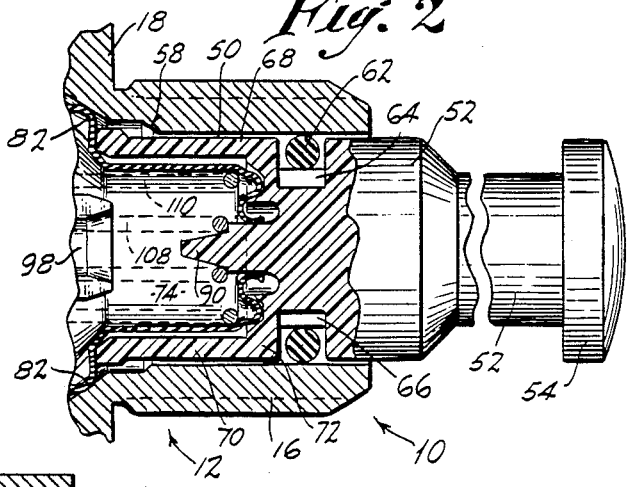
FIG. 2 is a fragmentary axial section of the switch of FIG. 1, with the actuator plunger having been initially depressed part way toward its fully circuit opening position.
Figure 3:
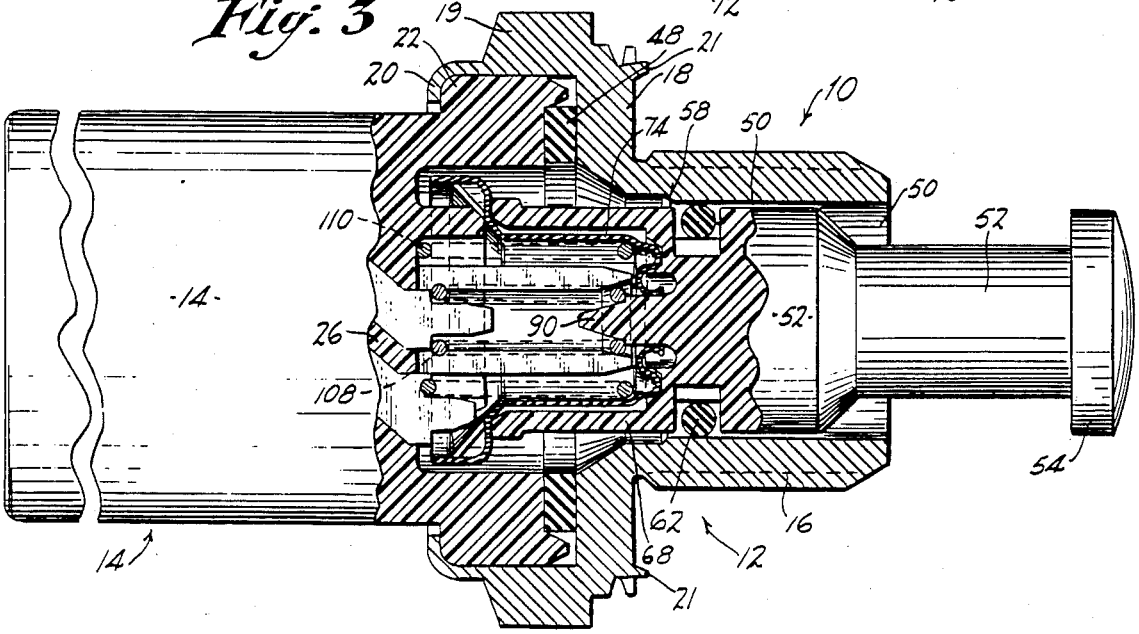
FIG. 3 is a similar view, partly in axial section and partly in elevation, showing the plunger of the switch in a fully depressed, circuit opening position.
Figure 7:
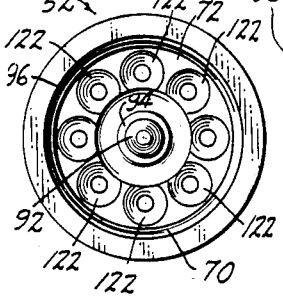
FIG. 7 is a left end elevation of the plunger of FIG. 6.
Figure 13:
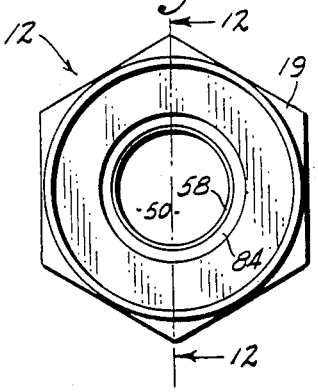
FIG. 13 is a left end elevation of the housing portion shown in FIG. 12.
Figure 12:
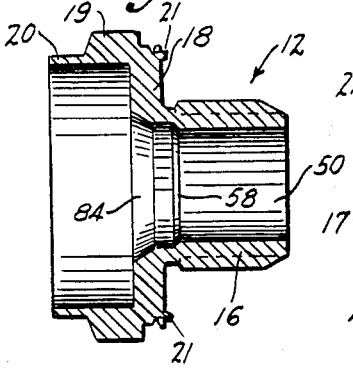
FIG. 12 is an axial section of a contactor portion of the housing of the switch of FIGS. 1–3. The view is taken on the line 12—12 of FIG. 13.
Figure 14:
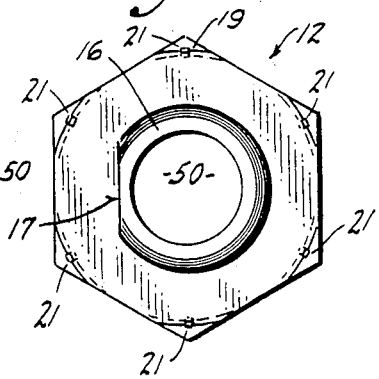
FIG. 14 is a right end elevation of the housing portion shown in FIGS. 12 and 13.

Referring to FIGS. 1–3 there is provided a switch mechanism adapted to be carried on a mounting panel 11 which can be a flat metal plate, channel, strut, beam, or other electrically-conductive structural member. The panel is shown in FIG. 1 in dotted outline. The switch is generally designated by the numeral 10 and comprises a two part housing, one part 12 being constituted of metal and the other part 14 of molded plastic or other insulating material. The metal part 12 is particularly shown in FIGS. 12–14, comprising a threaded barrel 16 and an integral flange 18 having a hex-configuration 19 engageable by a suitable wrench, to hold the flange stationary and thereby enable a nut (not shown) to be applied to the barrel. The metal housing part 12 has an annular flange 20 that is curled over an annular shoulder 22 on the molded housing part 14 so as to permanently retain the two in assembled relation. Optionally, the threaded barrel 16 can have a flat 17 to enable the barrel to be inserted into D-shaped hole and thereby keyed against rotation.

The surface of the flange 18 is provided with a plurality of sheared metal teeth 21, shown as being six in number, which are formed by a suitable shear tool (not shown). The teeth 21 project above the surface and will thus tend to puncture or break through any paint, oxidation, or other non-conductive film on the mounting surface for the switch. Thus, a good electrical contact will be established between the metal part 12 and such mounting surface 11 when the nut is assembled onto the barrel and tightened. These teeth are shown in FIGS. 1, 3, 12 and 14. They are integral with the remaining parts of the flange, having been formed by shearing, as noted above.

Figure 15:
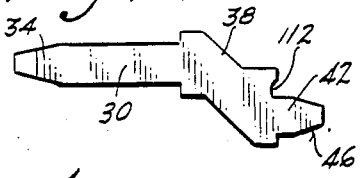
FIG. 15 is a plan view of the other of two terminals and connector means employed in the switch of FIGS. 1–3.
Figure 16:
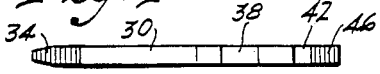
FIG. 16 is an edge view of the terminal and connector means of FIG. 15.

The molded housing part 14 is particularly illustrated in FIGS. 17–20. The part is in the form of an insulating block, and has a cavity or recess 24 adapted to accept an electrical receptacle connector (not shown) preferably of a type having a boot that seals the recess 24 from the exterior of the housing, thereby preventing dirt or other debris from entering. The molded housing part 14 is made with a transverse bottom wall 26 in which there are embedded two terminals 28 and 30 respectively, the terminal 28 being particularly shown in FIGS. 4 and 5 and the other terminal 30 being illustrated in FIGS. 15 and 16. The terminals 28 and 30 are preferably constituted of flat, stamped metal, and have tapered outer end portions 32 and 34, respectively. The angularly disposed portions of the stampings, embedded in the transverse wall 26, are indicated by the numerals 36 and 38, with the inner portions of the stampings labelled 40 and 42. These inner portions are also tapered, as at 44, 46 respectively to provide a lead-in for seating compression coil springs to be described below. The housing part 14 has another recess 47 on the opposite side of the transverse wall 26.

Figure 21:
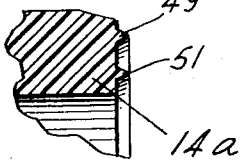
FIG. 21 is a fragmentary axial section of a modified molded plastic housing portion, for substitution in the switch device of the previous figures.
Figure 17:
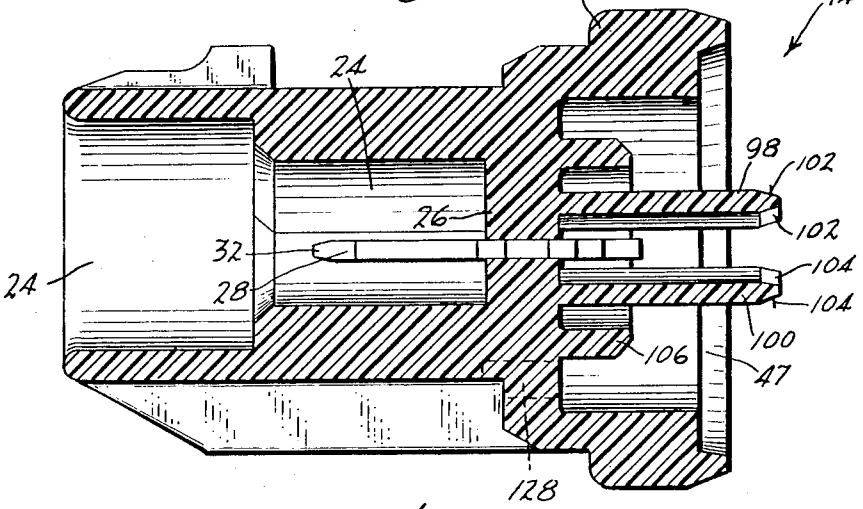
FIG. 17 is an axial section of a molded plastic portion of the housing of the switch of FIGS. 1–3.

Disposed between the housing parts 12 and 14 is a sealing gasket 48, which is compressed slightly during assembly in order to provide a seal of the interior of the housing as will be explained below. In place of the gasket 48, the housing part 14 can be provided with one or two annular upstanding beads 49, 51 which have relatively sharp crests and which are intended to crush slightly when the housing portions are assembled. The beads thus constitute a seal between such portions. Such a modification is shown in FIG. 21.

Figure 6:
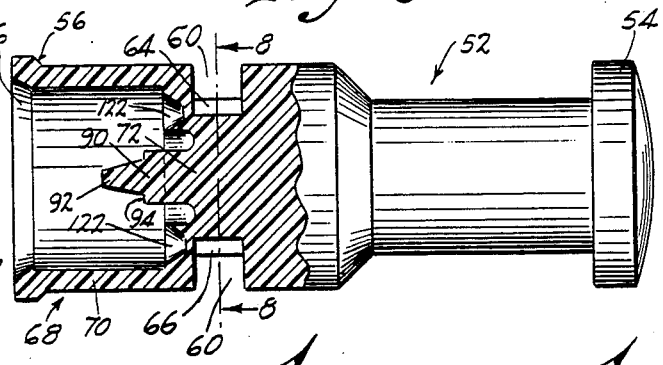
FIG. 6 is a view, partly in axial section and partly in elevation, of the plunger employed in the switch of FIGS. 1–3.
Figure 8:
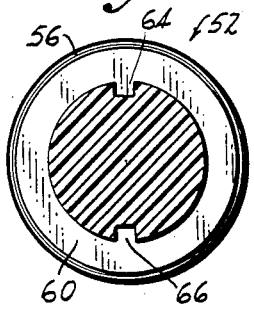
FIG. 8 is a section taken on the line 8—8 of FIG. 6.

The housing part 12 has a bore 50, and slidably carried therein is a plunger or push button 52 having a knob 54 and a retainer shoulder 56, FIG. 6, that is intended to be engaged by a cooperable internal annular shoulder 58 in the bore 50. The knob 54 can be omitted, if desired, in which case the plunger would assume a cylindrical configuration (not shown) at its outer end. Spaced from the inner end of the plunger is an annular transverse external groove 60 which receives an O-ring 62. The latter provides a seal against the walls of the housing bore 50; in order to reduce resistance to axially inward movement of the plunger which might otherwise result as the air in the bore is compressed, small by-pass passages are preferably incorporated in the plunger, adjacent the location of the O-ring. Two such passages 64 and 66 are illustrated. These passages permit a limited venting of air from the interior when the plunger 52 is initially depressed, and also allow air to re-enter the bore 50 when the plunger 52 is released. In the absence of such passages, it is possible that the piston effect of the plunger 52 might interfere with its free movement and lead to poor functioning and perhaps undue stresses on the switch housing parts 12 and 14.

Figure 10:
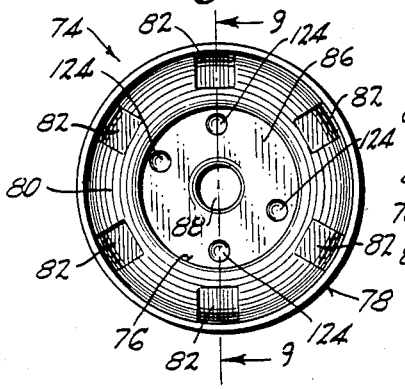
FIG. 10 is a left end elevation of the cup of FIG. 9.
Figure 9:
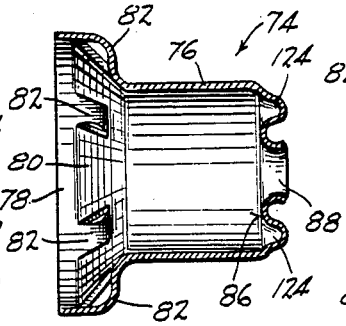
FIG. 9 is an axial section of the contact cup or movable abutment member employed in the switch of FIGS. 1–3. The view is taken on the line 9—9 of FIG. 10.
Figure 11:
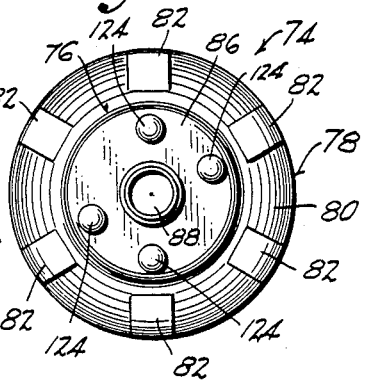
FIG. 11 is a right end elevation of the cup of FIGS. 9 and 10.

Referring again to FIGS. 1–3 and 6–8, the plunger 52 has a cup formation 68 at its inner end, with an annular side wall 70 and a transverse bottom wall 72, the cup formation 68 being adapted to provide a seat and guide for a movable switching abutment means which is electrically conductive and which comprises a metal contactor cup 74. The metal cup 74 has an annular wall 76 which is received in the cup 68 of the plunger 52, and also a larger diameter annular wall 78 having a rim, the wall being joined to the smaller diameter wall 76 by a conical wall 80. In the wall 80 are lanced projections 82 adapted to engage a contact or seat 84, FIG. 12, of the housing part 12, the seat being of generally conical configuration. The contact 84 can be considered an electrical terminal since it is electrically at the potential of the remainder of the housing part 12. The bottom transverse wall 86 of the switching abutment means or cup has a central aperture 88, as shown in FIGS. 9–11, and when the switch is assembled as in FIG. 1, a central projection 90 disposed at the transverse wall 72 of the plunger cup 68 can project through the aperture 88. The projection 90 has a tapered inner end 92, shown as being of generally conical configuration, and disposed at the base of the cone is an annular shoulder 94 which constitutes a seat for a compression coil spring to be described below. A lead-in surface 96 on the rim of the plunger cup 68 facilitates insertion of the contact cup 74 during assembly.

Figure 20:
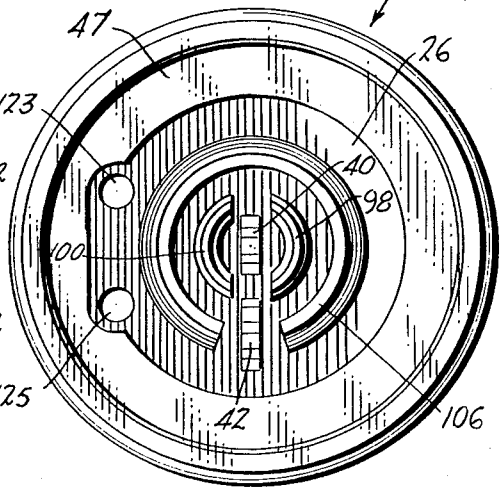
FIG. 20 is a right end elevation of the housing portion of FIGS. 17–19, employed with the switch of FIGS. 1–3.
Figure 18:
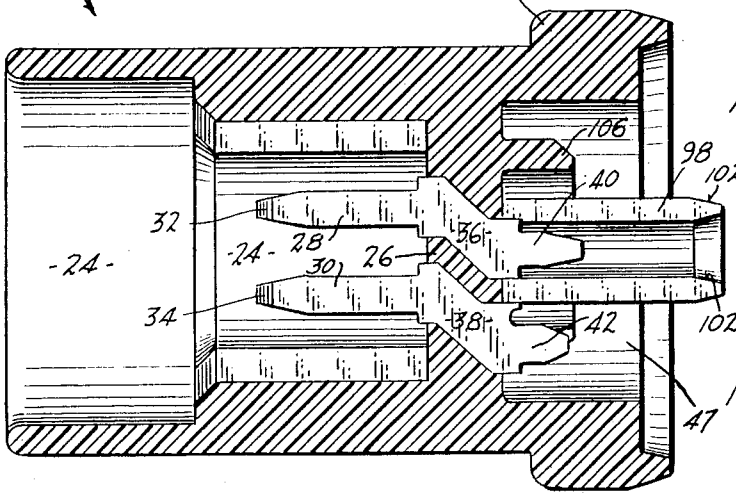
FIG. 18 is an axial section of the housing portion of FIG. 17, taken at 90° with respect thereto.

On the inner surface of the transverse wall 26 of the insulating housing part 14 is a pair of upstanding projections 98 and 100, each preferably being in the form of a section of a cylinder. The ends of the projections are tapered, as at 102 and 104, in order to provide a lead-in for installation of the springs to be described. The inner surface of the wall 26 of the housing 14 also has a cylindrical projection 106, which constitutes a stop shoulder engageable with the contact cup 74 when the latter is shifted by the plunger 52 to the relative positions of FIG. 3. This stop shoulder 106 is best illustrated in FIG. 20. It has a generally cylindrical form, but with an elongate notch to provide clearance for the inner portion 42 of the stamping.

Figure 4:
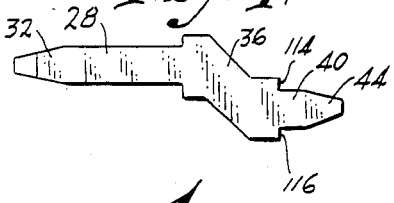
FIG. 4 is a plan view of one of the electrical terminal and connector means employed in the switch of FIGS. 1–3.
Figure 5:
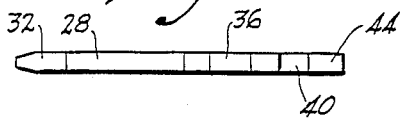
FIG. 5 is an edge view of the terminal and connector means of FIG. 4.

Referring again to FIGS. 1–3, the two compression springs are designated by the numerals 108 and 110, these being concentric and coaxial with one another. The outer spring 110 has its one end located in the recess formed by the cylindrical projection 106, while the inner spring 108 has its one end located in another recess formed by the two semi-cylindrical projections 98 and 100. The outer spring 110 is also received in a notch 112 formed in the portion 42 of the stamping, so as to establish good electrical contact therewith, while the inner spring 108 engages two opposed shoulders 114 and 116 on the other portion 40, as shown in FIG. 4. The springs 108, 110 thus establish a good electrical contact with the terminals 28, 30 respectively, as can be readily understood. The lead-in formations or tapered portions 44, 46 facilitate initial installation of the parts of the switch housing and assist the springs 108, 110 in seating properly.

With the above arrangement, it can be seen that with the plunger 52, springs 108, 110 and abutment means or cup 74 in the relative positions of FIG. 1, there is established continuity between each of the terminals 28 and 30, through the respective springs 108, 110 to the abutment means 74 and thence to the conductive portion or seat 84 of the housing part 12. The springs 108, 110 bias the parts to the position shown in FIG. 1, hereinafter known as the closed circuit position. The rim of the cup 74 is disposed at the entrance to the recess 47, as illustrated.

FIG. 2 illustrates the relative positions of the various parts as the plunger 52 is initially depressed from the position of FIG. 1 toward that of FIG. 3. When the plunger 52 is first moved, the inner spring 108 is unseated from the cut 74 as shown, thereby interrupting the circuit from the housing part 12 to the one electrical terminal 28. Continuity between the housing part 12 and the other terminal 30 is maintained, however, since no movement of the cup or abutment means 74 with respect to the housing has occurred. Continued depressing movement of the plunger will now result in the cup 68 of the plunger 52 engaging the cup 74, which will unseat the latter from the housing part 12 and thereby interrupt the circuit between the part 12 and the other electrical terminal 30. The plunger 52 and cup 74 can be further depressed until the latter engages the stop shoulder 106 as in FIG. 3. It is noted that even after such engagement occurs, a small space exists between the bottom of the contact cup 74 and the ends or tips of the projections 98, 100. The shoulder 106 thus tends to protect the projections 98, 100 against damage or breakage as otherwise might result from a depressing force of excessive magnitude being inadvertently applied to the plunger.

It is to be noted that the switching is accomplished in sequence, that is, first the terminal 28 is isolated from the other terminal 30 and housing part 12, and then the remaining terminal 30 is isolated. At no time is there established a condition where the two terminals 28 and 30 are connected to one another and not to the housing part 12. Such an arrangement can have important advantages where is it absolutely necessary to maintian open circuit isolation between the terminals 28 and 30. Generally it is assumed that the housing part 12 would be connected to electrical ground, through its mounting to a chassis or vehicle ground, but other applications are possible. For example, if the metal housing part 12 were to be mounted on an insulating surface, the switch would become a single pole, single throw type with respect to terminals 28 and 30.

During the movement of the plunger 52 it will be understood that air can pass through the passages 64 and 66 and past the O-ring 62 in order to balance the pressures on opposite sides of the ring 62 and thus eliminate the piston effect of the plunger. Such an effect might otherwise interfere with its free movement.

Further, the plurality of outwardly lanced portions 82 shown in FIGS. 9–11, constitute contact projections that are adapted to engage the annular seat 84 (FIG. 12) of the housing part 12 and provide for increased unit pressures over that which would occur were a single annular seat to be provided on the cup 74. By reducing the areas of contact between the cup 74 and the seat 84, there is effected an increased pressure per unit area between the parts, which results in an improved electrical contact and reduces the likelihood of contact degeneration over extended periods of use.

Also, cooperable means are provided on the transverse wall 72 of the plunger 52 and on the cup 74, for effecting small increments of rotation of the latter with respect to the housing part 12 and plunger 52 as the plunger is operated. In accomplishing this object, there is provided on the surface of the transverse wall 72 of the plunger a series of recesses 122, shown as being eight in number, and each having a generally conical surface configuration. Disposed on the transverse wall 86 of the cup 74 is a series of nibs or protrusions 124, shown as being four in number. As can be readily seen, the eight recesses 122 are disposed circumferentially 45° from one another, and are symmetrical with respect to the axis of the plunger 52. On the cup 74 the protrusions 124 are shown as being in two sets of diametrically opposed pairs. The circumferential disposition between two of the adjacent protrusions 124 is 67.5°, which figure was derived by multiplying 45° by 1.5.

With such arrangement, it has been found that when initial engagement of the cup 74 with the transverse wall 72 of the plunger cup 68 occurs, it is unlikely that either of the pairs of protrusions 124 will align exactly with any of the opposed pairs of the recesses 122. Accordingly, assuming that the plunger 52 is not subject to any significant rotation while it is being forcibly depressed, the contact cup 74 will rotate until one pair of protrusions 124 does seat in a corresponding pair of recesses 122, at which time the remaining pair of protrusions 124 will be disposed precisely between a pair of adjoining recesses 122. As presently understood, the deliberate misalignment between the protrusions 124 and recesses 122 will give rise to a slight rotation or turning of the cup 74 each time that the switch plunger 52 is actuated. As a result, different parts of the cup 74, namely different ones of the fingers 82 will come to rest in different places on the conical seat 84 of the housing part 12 at the time that the plunger 52 is released. Stated differently, when the plunger 52 is depressed, the cup 74 will rotate slightly, in either direction. Upon release of the plunger 52, the cup 74 will return to the position of FIG. 1, but with a slightly different angular orientation, and the contact areas between the cup 74 and seat 84 will be correspondingly different. It is believed that this construction leads to improved contact life by reducing the likelihood of wear of the contact surfaces, resulting from repeated like engagement and disengagement therebetween. In some respects the action of the cup 74 on the seat 84 can be thought of as similar to a wiping action which occurs in some electromechanical devices, and which is purposely introduced in such devices in order to reduce the effects of oxidation on the contacts.

Figure 19:
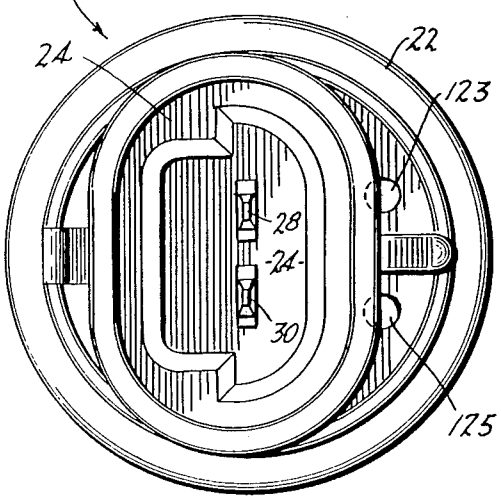
FIG. 19 is a left end elevation of the housing portion of FIGS. 17 and 18, employed with the switch of FIGS. 1–3.

As an alternative to providing the passages 64 and 66 in the plunger 52 at locations adjacent the O-ring 62, there can be provided in the plastic housing part 14, of one or two vent holes that provide communication between the bore 50 of the housing and the exterior thereof. Two such vent passages 123 and 125 are shown in FIGS. 19 and 20; it is believed that by making such passages sufficiently small, adequate pressure equalization can be provided on the initial depression of the plunger, while at the same time minimizing the possibility of dirt or other debris entering the interior of the housing, and contaminating the areas of contact between the connector portions or means 40, 42, the springs 108, 110, and between the springs 108 and 110 and the cup 74, as well as between the cup 74 and its seat 84. As can be readily understood, either venting arrangement can be employed, or both, if desired.

A modified construction is shown in FIGS. 22–30, involving plunger construction adapted to be substituted for the plunger 52 of FIGS. 1–3 and 6–8. The modified plunger is designated 52*a*, and has a transverse wall 72*a* constituting the bottom of a cuplike end structure or calibrating cavity to be desribed below. As in the previous embodiment, the inner end of the plunger 52*a* has a cup structure 68*a* which receives and constitutes a seat for the contact cup 74 of FIGS. 9–11. The modified plunger 52*a* also has a transverse annular groove 60*a*, similar to the groove 60, which is adapted to receive a sealing O-ring. Small passages 64*a*, 66*a* are provided, constituting vents, to enable gas occupying the area within the switch housing to be expelled when the plunger 52*a* is initially depressed, thereby minimizing the piston effect thereof, as explained previously.

The plunger is constituted of two separate parts, enabling the length of the composite plunger to be automatically self-calibrating to a predetermined desired figure based on the dimensions and clearances of the environment in which the switch is to be employed. The plunger parts are designated 126 and 128, respectively, and have an interference or press fit with one another such that under application of a predetermined force applied to the part 128, it can retract with respect to the part 126. The plunger thus constitutes a take-up mechanism which can compensate for dimensional variations resulting from installations having differing physical sizes. There is thus avoided possible damage to the plunger parts, or to the switch housing or switch contacts.

The part 126 has a cup-like end configuration defining a calibrating cavity 130 with an annular side wall 132. The cavity 130 is provided with four longitudinal passages 134 which provide clearance spaces for four corresponding vane-like structures 136 on the other plunger part 128. In the disclosed embodiment the press-fit occurs between the four surfaces 138 constituting the small diameter portion of the bore, and the corresponding four circumferential surfaces 140 on the other plunger part 128 which are disposed between the four vanes 136. As shown, the vanes 136 have a generally triangular cross-sectional configuration, and are received in the longitudinal passages 134 of the plunger part 126, so as to key the parts 126, 128 with respect to one another. There is preferably a small pressure between the longitudinal edges of the vanes 136 and the adjacent, cylindrical surfaces of the passages 134, but the vanes are not sufficiently rigid to provide any substantial degree of controlling frictional engagement between the parts 126, 128.

As shown the plunger part 128 has a generally conical lead-in surface 141 that is cooperable with lead-in segments 142 that are sections of a cone on the part 126, in order to facilitate initial assembly. These surfaces are particularly shown in FIGS. 22, 25 and 27. Similar lead-in surfaces are provided on the inner ends of the vanes 136, and on the lip of the calibrating cavity 130 of the plunger part 126.

Figure 22:
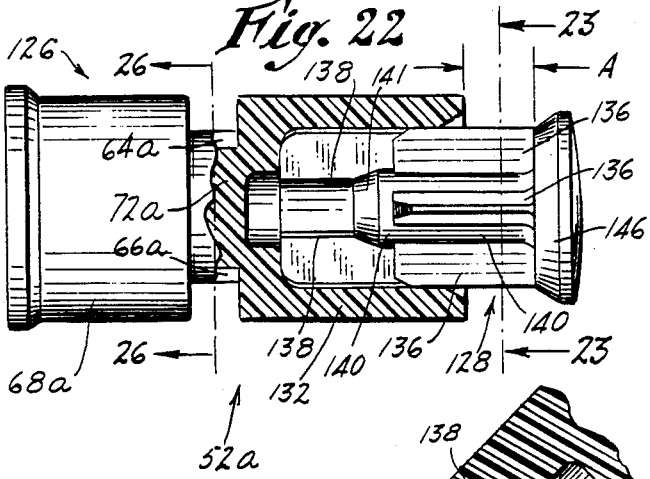
FIG. 22 is a view, partly in elevation and partly in axial section, of a two-part automatically calibrating plunger adapted to be substituted for that shown in the switch mechanism of FIGS. 1–3.
Figure 23:
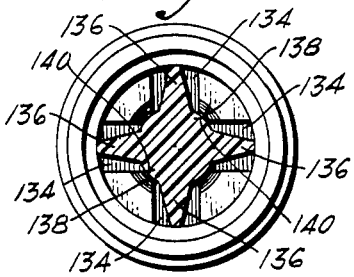
FIG. 23 is a section taken on the line 23—23 of FIG. 22.
Figure 25:
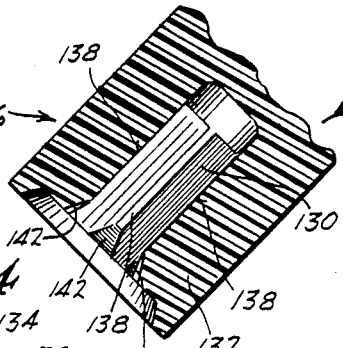
FIG. 25 is a section taken on the line 25—25 of FIG. 24.
Figure 24:
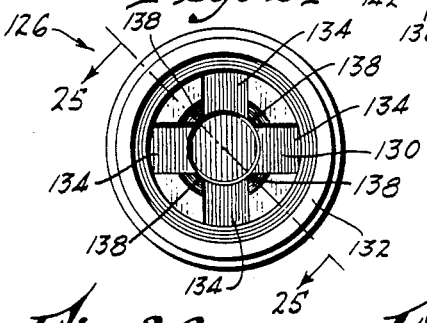
FIG. 24 is a right end elevation of one part of the plunger shown in FIGS. 22 and 23.
Figure 26:
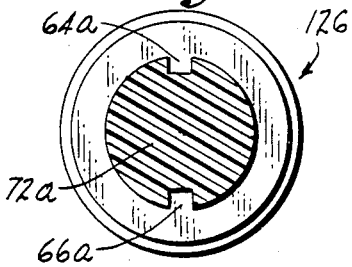
FIG. 26 is a section taken on the line 26—26 of FIG. 22.
Figure 28:
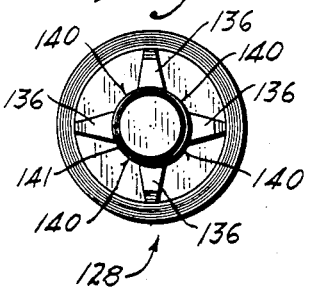
FIG. 28 in a left end elevation of the plunger part of FIG. 27.
Figure 27:
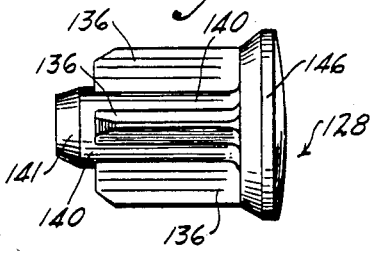
FIG. 27 is a side elevation of the other part of the plunger shown in FIGS. 22 and 23.
Figure 29:
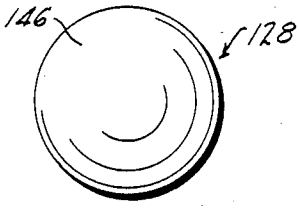
FIG. 29 is a right end elevation of the plunger part of FIGS. 27 and 28.
Figure 30:
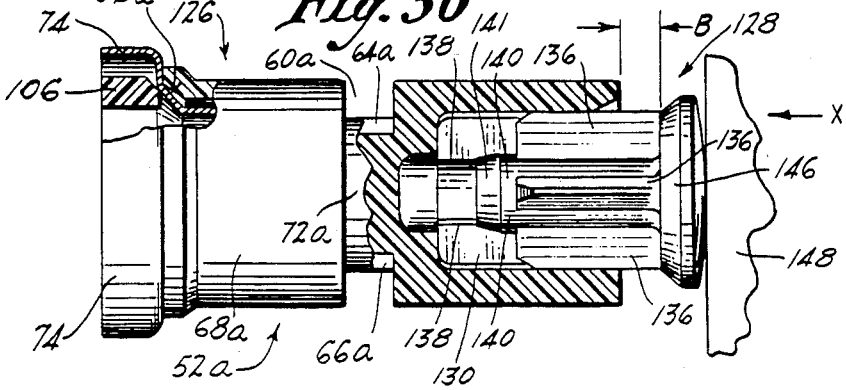
FIG. 30 is a view similar to FIG. 22, except showing the plunger parts as having been relatively retracted partially, due to force applied by an actuator member.

The plunger part 128 preferably has an enlarged button 146 at its outer end, constituting shoulder means that is adapted to be engeged by an abutment member 148, as in FIG. 30. In FIG. 22, the plunger parts 126, 128 are shown as occupying a first position wherein they are mostly extended with respect to one another, but there exists a sufficient retention such that the parts will not loosen. FIG. 30 shows the abutment member 148 having been forcibly moved in the direction indicated by the capital letter "X", wherein it has engaged the button 146 and shifted or retracted the plunger part 128 into the plunger part 126. The shifting occurs along a linear path, and parallel to the axes of the plunger parts, as can be readily seen. The distance indicated by the capital letter "A" in FIG. 22 has, in FIG. 30, been reduced to the dimension "B". This has occurred because the plunger comprising both parts 126, 128 was initially depressed until the contact cup 74 that was being driven by the shoulder 96*a*, arrived at the stop shoulder or abutment 106 as in FIG. 30, while force was still being applied to the plunger part 128. Where the applied force exceeds a predetermined, desired figure the relative adjustment of the part 128 will occur automatically, thus providing the proper dimension to the overall length represented by the telescoped plunger parts 126, 128. The dimension "B" in FIG. 30 could be reduced further than that shown, as required by the final position of the member 148. Thus the switch plunger is seen to be self-adjusting as to its overall length, with such adjustment occurring automatically after the switch device has been permanently installed in its ultimate position.

It is believed that in the absence of an automatic calibration arrangement such as set forth in FIGS. 22–30, there might occur damage to the switch. That is, if the switch housing were to be rigidly mounted to a supporting surface in the engine compartment of a vehicle, with the plunger adapted for engagement by a surface 148 on the underside of the hood, great care would have to be exercised in order to insure that forcible closing or slamming of the hood did not depress the plunger to the extent that it would be crushed. Thus the tolerances of various mechanical parts on the vehicle would have to be monitored to a considerably greater extent, more so than is considered warranted at the present time.

The modified construction illustrated in FIGS. 22–30 has the following important advantage. By incorporating an arrangement whereby the overall length of the plunger can be automatically adjusted after the unit is installed in its particular environment, only minimal consideration need be given to tolerances relating to the absolute length of the plunger and switch housing assembly. Very often such tolerances are difficult to control. In the present switch plunger arrangement, reliance is placed mostly on obtaining a close tolerance on the diameter of the bore of the one plunger part 126 on the one hand, and the outer diametric or circumferential surface of the cooperable plunger part 128, on the other. Diametric or circumferential dimensions, as provided herein, can be closely held and controlled, as compared with linear or like dimensions, and this is a feature of present construction. Where such parts are constituted of molded plastic, it is relatively easy to control tolerances of this nature, much more so than attempting to monitor dimensional variations involving the overall length of a completed switch assembly, where multiple individual, separate pieces are employed.

Figure 32:
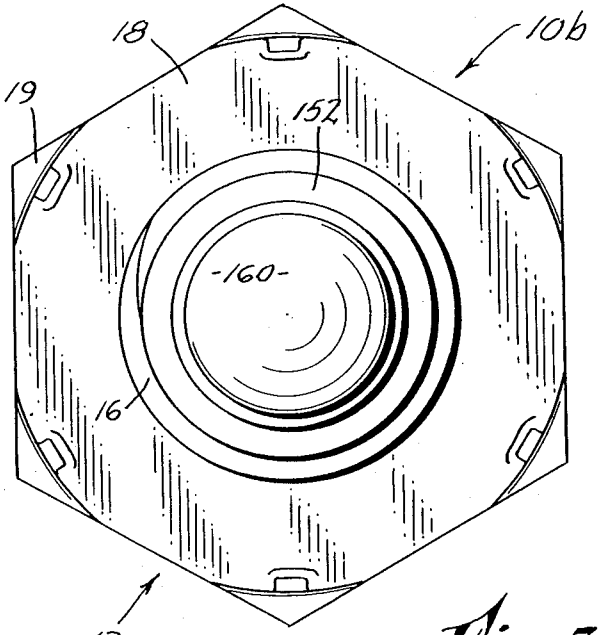
FIG. 32 is a right end elevation of the switch construction of FIG. 31.
Figure 31:
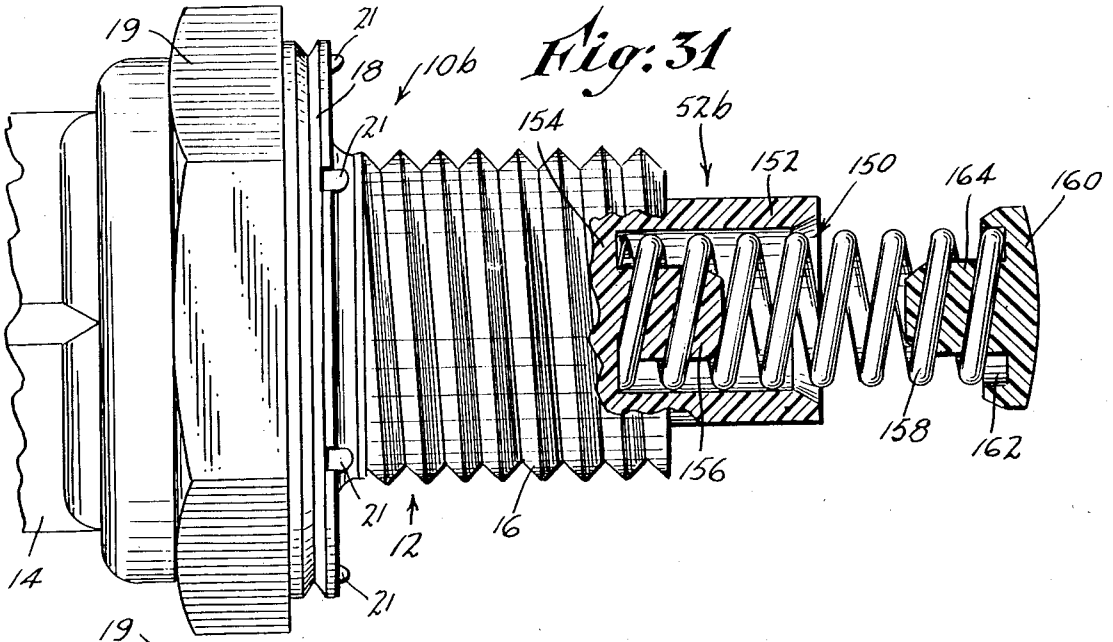
FIG. 31 is a view, partly in elevation and partly in axial section, of another embodiment of switch construction incorporating a self-adapting spring mechanism associated with the switch plunger, for accommodating overtravel and subsequent back-off or re-bound of an external actuator, such as the hood of a motor vehicle.
Figure 33:
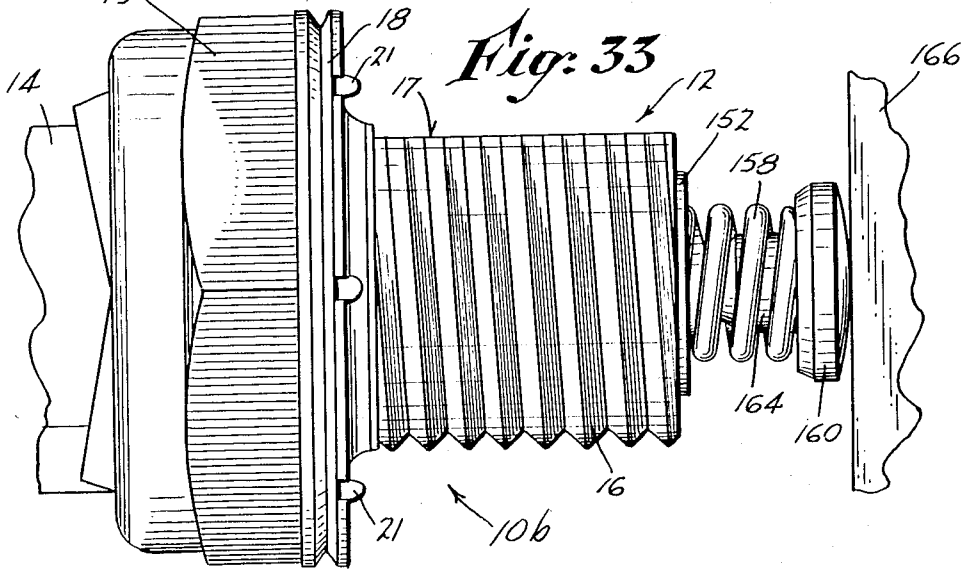
FIG. 33 is a view like FIG. 31, except illustrating the external actuator or hood as being in engagement with the self-adapting mechanism of the switch, and wherein the spring associated with the mechanism is compressed.

FIGS. 31–33 illustrate another embodiment of switch construction 10b for installation on a mounting panel similar to that shown in FIG. 1 and indicated in that figure by the numeral 11. As in the previous arrangement, the switch comprises a two-part housing, one part 12 constituted of metal and the other part 14 constituted of plastic. The metal part 12 has a threaded barrel 16 and integral flange 18 having a hex-configuration 19 engageable by a wrench, to facilitate installation. A flat 17 on the barrel 16 enables the part 12 to be inserted into a D-shaped hole (not shown) in the panel 11. The flange 18 has sheared teeth 21 that can penetrate paint on the surface of the panel 11, and thereby insure electrical contact therewith. The remaining portions of the housing of the switch 10*b* are similar to that shown in FIGS. 1–3.

In accordance with the present invention there is provided a unique plunger designated 52*b*, having a cup-like configuration at its inner end, similar to that indicated 68 in FIG. 6, and which constitutes a housing for the metal contactor cup 74 of FIGS. 9–11. At its outer end, the plunger 52*b* has a cylindrical recess 150 formed by an annular side wall 152, bottom wall 154, and in addition has a substantially cylindrical, upstanding projection 156 integral with its bottom wall 154. The walls 152, 154 and projection 156 in accordance with the invention, form an annular seat for the inner end of a support-providing compression coil spring 158. The outer end of the spring 158 constitutes a support means and carries or supports a button 160, constituting an abutment member. The outer spring end is free-standing, and is exposed and accessible. The button or member 160 also has an annuylar recess 162 and a central projection 164. The dimensions of the two projections 156 and 164 are such that they fit snugly into the opposite ends of the spring 158. Stated differently, the opposite ends of the spring snugly fit into the recess formed by the walls 152, 154 and projection 156, and into the recess 162, respectively. The spring has the usual inner and outer helical surfaces, as shown in FIG. 31 (unnumbered), the inner surface engaging the projection 156. The button preferably has a convex outer face for engagement by an actuator 166 shown in FIG. 33, such as a panel of the hood of a vehicle, a trunk lid panel or the panel at the edge of a vehicle door.

Normally, the springs 108 and 110 (FIGS. 1–3) bias the plunger 52*b* to the position shown in FIG. 31 in the absence of a force applied to the button 160. By the invention, when the actuator 166 engages the button 160, as in FIG. 33, the button-supporting spring 158 is compressed as the plunger 52*b* is being depressed. In the case of an automobile hood 166 striking the button 160 with considerable force, and where a certain amount of overtravel of the hood occurs, the compression of spring 158 takes up the added motion; following closing of the hood, any re-bound or subsequent retraction, under the action of the hood's bumper pads (not shown) is, for the most part, taken up by a partial re-extending of the spring 158, and not by retraction of the plunger 52*b*. The spring 158 thus serves a number of purposes. It largely absorbs the high-amplitude, initial impulse force that would otherwise be applied by the vehicle hood 166 to the plunger 52*b*; in addition, being slightly less stiff than the combined stiffness of springs 108 and 110, the spring 158 thereafter expands slightly in response to re-bounding movement of the hood, such that there occurs only relatively little retraction of the plunger 52*b* and the metal contactor cup 74, FIGS. 9–11, carried thereby.

Moreover, the spring 158 is sufficiently stiff so that it adequately, operatively mounts the button 160 at all times, even when free of stress as in FIG. 31.

In actual tests, the disclosed arrangement has been found to provide excellent results in accomplishing the objectives just noted in the previous paragraphs.

Further, by the invention, the provision of the projections 156 and 164 which are received in the opposite ends of the spring 158 results in a desired retention of the spring 158 and button 160 on the plunger 52*b* in the event that there is applied to the button 160 an outwardly directed force. Application of such a force tends to decrease the diameter of the spring 158, causing it to grip more tightly the projections 156 and 164 on the plunger 52*b* and button 160, respectively. The likelihood of the parts inadvertently becoming separated is thereby greatly reduced. This feature of the invention is considered important inasmuch as inadvertent loss of the button or spring would result in malfunctioning of the switch.

In other respects the operation of the self-adapting switch construction of FIGS. 31–33 is identical to that of the previously described switch structures, and accordingly it is considered that further description relating to functioning of the various parts is not necessary.

From the above it can be seen that we have provided a novel and improved self-adapting switch construction which is simple in its structure and both rugged and reliable over extended periods of use. Excessive stresses which might be applied to the switch plunger are effectively dampened by the arrangement shown in FIGS. 31–33. Also overcome is the problem of overtravel and re-bound of the actuator 166, which, as noted above, can be a relatively massive object such as a vehicle hood.

The likelihood of contact deterioration is minimized by the use of a sealed-type switch housing, whereby accumulation of moisture and debris is minimized. The rotation or turning movement of the cup 74 during operation of the switch is believed to be an important feature as regards maintenance of contact integrity.

Assembly of the switch can be automated, if desired, and the overall manufacturing expense minimized through the use of relatively simple molded plastic pieces, and stamped sheet metal parts. The device is thus seen to represent a distinct advance and improvement in the field of electrical switches.

Each and every one of the appended claims defines an aspect of the invention which is separate and distinct from all others, and accordingly it is intended that each claim be treated as such when examined in light of the prior art devices in any determination of novelty or validity.

Variations and modifications are possible without departing from the spirit of the invention.

What is claimed is;

1. A self-adapting electric switch construction comprising, in combination:

(a) a body member having means for attaching it to a supporting structure, and having a stationary electrical contact, (b) a movable electrical contact cooperable with said stationary contact for making and breaking an electrical circuit, (c) means for movably mounting said movable contact on the body member, (d) said body member having a movable plunger operable to actuate said movable contact, and (e) a compression coil spring having an anchored end and an exposed, accessible free-standing end, said anchored end being carried by and retained by said plunger, said free-standing end being fully exposed and adapted for driving movement by an external actuator, thereby to constitute a yieldable driving means between the plunger and the external actuator.

2. The invention as set forth in claim 1, wherein:

(a) the compression coil spring is elongate, and is characterized by a predetermined inside diameter, (b) said plunger having a projection extending into the anchored end of the spring and having an external dimension substantially equal to the said inner diameter when the spring is not compressed, whereby the spring is normally retained on the said plunger projection against inadvertent loss when the plunger is not being depressed.

3. The invention as set forth in claim 1, wherein:

(a) the compression coil spring is elongate, and is characterized by a predetermined inside diameter, and (b) an abutment member carried by the exposed free-standing end of the spring, said abutment member having a projection extending into the exposed free-standing end of the spring and having an external dimension substantially equal to the said inner diameter when the spring is not compressed, whereby the abutment member is normally retained on the said spring against inadvertent loss when the plunger is not being depresed.

4. The invention as set forth in claim 2, wherein:

(a) said plunger having an outer end and an inner end, said plunger has a recess in its outer end, the side and bottom walls of the recess and the said plunger projection forming an annular seat for said anchored end of the compression coil spring.

5. The invention as set forth in claim 3, wherein:

(a) said abutment member has a recess in its end, the side and bottom walls of the recess and the said abutment member projection forming an annular seat for the said free-standing end of the compression coil spring.

6. The invention as set forth in claim 1, wherein:

(a) said compression coil spring has inner and outer helical surfaces, (b) said plunger having means engageable with said inner surface, for operatively mounting and retaining said spring in its operative position.

* * * * *